US007178821B2

(12) United States Patent
Miller et al.

(10) Patent No.: US 7,178,821 B2
(45) Date of Patent: Feb. 20, 2007

(54) UNIVERSAL SKI AND SNOWBOARD BINDING

(75) Inventors: Matthew E. Miller, Provo, UT (US); Douglas K. Furr, Provo, UT (US)

(73) Assignee: Miller Sports International, Inc., Provo, UT (US)

( * ) Notice: Subject to any disclaimer, the term of this patent is extended or adjusted under 35 U.S.C. 154(b) by 185 days.

(21) Appl. No.: 10/467,941

(22) PCT Filed: Feb. 15, 2002

(86) PCT No.: PCT/US02/05174

§ 371 (c)(1),
(2), (4) Date: Aug. 14, 2003

(87) PCT Pub. No.: WO02/064222

PCT Pub. Date: Aug. 22, 2002

(65) Prior Publication Data

US 2004/0070176 A1 Apr. 15, 2004

(51) Int. Cl.
*A63C 9/00* (2006.01)

(52) U.S. Cl. ..... 280/624; 280/617; 280/620

(58) Field of Classification Search ..... 280/611, 280/613, 616, 617, 620, 623, 625
See application file for complete search history.

(56) References Cited

U.S. PATENT DOCUMENTS 3,061,325 A 10/1962 Glass
3,944,237 A * 3/1976 Teague, Jr. ..... 280/618
4,163,569 A 8/1979 Horn
4,290,213 A * 9/1981 Salomon ..... 280/613
4,505,493 A 3/1985 Gustavsson
4,923,207 A * 5/1990 Pozzobon ..... 280/613
5,915,721 A * 6/1999 Laughlin et al. ..... 280/617
5,947,508 A * 9/1999 Graf et al. ..... 280/616
5,984,324 A * 11/1999 Wariakois ..... 280/14.24

(Continued)

FOREIGN PATENT DOCUMENTS

WO WO 99/13952 3/1999

*Primary Examiner*—Christopher P. Ellis
*Assistant Examiner*—Brian Swenson
(74) *Attorney, Agent, or Firm*—Thorpe North & Western LLP

(57) ABSTRACT

A universal binding apparatus for detachably securing footwear to an article is disclosed. The apparatus includes a base plate and a foot plate. The base plate attaches to the article while the foot plate attaches to the footwear. The base plate includes a toe latch, a heel latch, and a first release. The toe latch is disposed at a front portion of the base plate while the heel latch is disposed at a rear portion of the base plate such that the first release is also disposed between the toe latch and the heel latch. The first release enables either the toe latch or the heel latch to be disengaged from the foot plate. The foot plate includes a toe support and a heel support. The toe support is disposed at a front portion of the shoe plate similar to the front portion of the base plate and while the heel support is disposed at a rear portion of the shoe plate. The shoe plate removably attaches to the base plate with the toe support engaged with the toe latch and the heel support engaged with the heel latch. The first release operates to disengage either the toe latch or the heel latch or both from the foot plate.

30 Claims, 8 Drawing Sheets

U.S. PATENT DOCUMENTS 6,102,430 A 8/2000 Reynolds
6,182,999 B1 2/2001 Bourdeau
6,213,493 B1 * 4/2001 Korman ..... 280/613
6,257,613 B1 * 7/2001 Porte ..... 280/617
6,338,497 B1 * 1/2002 Chevalier et al. ..... 280/612
6,428,032 B1 8/2002 Humbel

* cited by examiner

UNIVERSAL SKI AND SNOWBOARD BINDING

BACKGROUND OF THE INVENTION

The present invention relates to ski bindings and, more specifically, the present invention relates to a universal ski binding that can be adapted for multiple purposes such as alpine skis, snowboards, water skis, wakeboards and the like.

Snowboarding, skiing, and other sliding, boarding, and rolling sports are increasing in popularity as a sport and recreational activity. Snowboarding is nearly as popular as skiing. Unfortunately, the safety aspects of snowboarding equipment lag behind that developed for skiing, particularly with respect to the binding mechanisms provided to hold the snowboard to the feet of the rider. The form of snowboard binding which is currently most broadly used includes two foot plates fastened to the snowboard, each foot plate having a plurality of straps adapted to fasten around a respective boot of the rider. In use, the rider places his or her boot clad feet on the foot plates and tightens the straps around the boots to secure the board to the rider's legs. In order to remove the board the rider must manually and individually unfasten each of the straps to release the snowboard bindings from the rider's boots. Other types of fasteners and bindings are also available, which include plate bindings and step-in bindings.

The United States Consumer Product Safety Commission has released statistics concerning snowboard safety, which indicates that the majority of snowboarding fatalities have resulted from suffocation in deep snow. With the snowboard unreleasably attached to the rider's feet, the length of the snowboard can act as an anchor in the event of a snow slide or avalanche, and once covered in snow the rider may not be able to reach the binding straps in order to remove the board. It may therefore be desirable for a snowboard binding to enable the rider's legs to be released from attachment to the board in the event of abnormal forces being applied, such as may occur in the case of a severe fall or an avalanche.

Ski bindings are traditionally designed to release the ski from the ski boot if abnormal forces are applied between the ski boot and ski binding, so that those forces are not transmitted to the skier's leg where they may cause injury. It would be advantageous, therefore, for snowboard bindings to have a similar safety feature, such that the likelihood of injury is decreased in the event of a severe fall, particularly one in which the body or legs of the snowboarder twist relative to the board. In the case of a snowboard binding release, preferably both feet should be released from the board during the fall, even if only one binding initially senses abnormal forces, since with only one leg secured to the snowboard the potential for injury to that leg is greatly increased.

Another difficulty associated with snowboard bindings occurs where the rider wishes to use a conventional ski lift or tow to return to the top of a mountain slope. In order to negotiate queues of people and the like the rider must generally free one foot from the board to maneuver into position to mount the ski lift. After alighting from the ski lift the free boot must then be re-fastened to the snowboard. The constant cycle of unfastening and re-fastening the conventional binding straps is both physically exhausting and time consuming, and it would therefore be desirable for an improved snowboard binding to enable easier fixing and release of at least one boot from the board when desired.

Not only is there a great safety concern with respect to the ski bindings used with snowboards, but often most skiers tend to ski not only with a snowboard but also with alpine skis. It becomes very expensive to maintain a set of skis with bindings that are distinct from one another that do not allow any universal interchange. For example, an individual may want to ski in the morning using alpine skis but later ski in the afternoon on a snowboard. In order to do so, the individual would have to change the bindings and ski boots being worn in order to use the alpine skis or the snowboard. Accordingly, it would be a great benefit to provide a universal binding that would be as efficient and applicable for alpine skis as it is for snowboards. Further, this universal binding should also be adaptable to other ski activities, including, but not limited to water skiing and other snow ski activities.

SUMMARY OF THE INVENTION

According to the present invention, a universal binding apparatus for detachably securing footwear to an article is disclosed. The apparatus includes a base plate and a foot plate. The base plate attaches to the article while the foot plate attaches to the footwear. The base plate includes a toe latch, a heel latch, and a first release. The toe latch is disposed at a front portion of the base plate while the heel latch is disposed at a rear portion of the base plate such that the first release is also disposed between the toe latch and the heel latch. The first release enables either the toe latch or the heel latch to be disengaged from the foot plate. The foot plate includes a toe support and a heel support. The toe support is disposed at a front portion of the shoe plate similar to the front portion of the base plate and while the heel support is disposed at a rear portion of the shoe plate. The shoe plate removably attaches to the base plate with the toe support engaged with the toe latch and the heel support engaged with the heel latch. The first release operates to disengage either the toe latch or the heel latch or both from the foot plate.

In an alternative embodiment, the base plate also includes a second release, disposed between the toe latch and the heel latch on a side opposite the first release, that operates to release either the toe latch or the heel latch that is not operated by the first release.

The universal binding apparatus is designed for use with such ski apparatus as snowboards, straight skis, water skis, wakeboards, and any other type of water or snow sport. Further, the invention can be utilized on roller skis where quick release and universal binding features are desired.

Both the toe latch and the heel latch may be independently adjusted to provide optimal release pressures suitable to the user of the article. Several springs are utilized to provide the release force necessary to make sure that the binding binds the footwear to the article, but also release in an emergency situation or when the user desires to be released.

DETAILED DESCRIPTION OF SPECIFIC EMBODIMENTS

Figure 1:
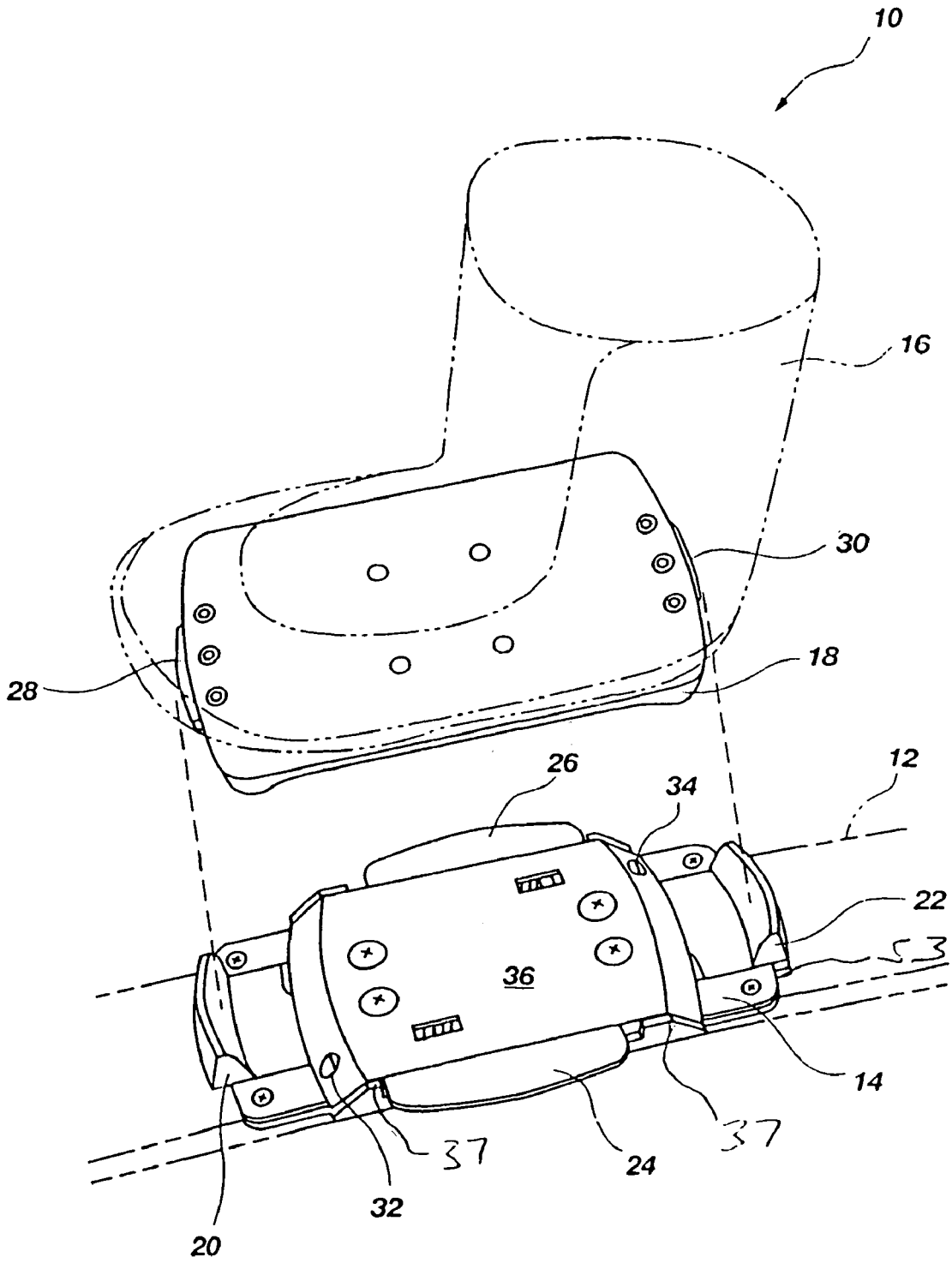
FIG. 1 illustrates a partially exploded perspective view of the universal binding apparatus according to the present invention.

A universal ski binding apparatus is illustrated in FIGS. 1–5. The universal binding apparatus 10 is illustrated for use with a flat or alpine ski 12, which has attached to it a releasable base binding or plate 14 that secures a boot or footwear 16 to ski 12 via a second securing or top plate 18.

The universal ski binding 10 makes both snowboard and ski bindings releasable. It serves as an interface that fits between a snowboard and a snowboard binding or a ski and a ski binding, respectively, to allow them to release the rider from the board at a preset pressure on impact. Further, the rider can perform a quick release via a quick release lever that has been heretofore lacking in the prior art. This enables a reduction in injuries and an increased safety level and performance in both snowboarding and skiing. Further, it provides vertical lift for added carving leverage and lessened toe and hill drag in the snow and fatigue to the rider commonly associated with prior binding systems. The release mechanism is also able to release at all required angles via the novel design interaction of the release surfaces of the mounting plate and the securing top plate. Importantly, the universal snowboard and ski binding provides multiple angles of release, which offers greater safety than the limited angles of release on current ski and snowboard bindings.

Base plate 14 further includes a toe kick latch 20 and a heel kick latch 22 that both slide forward or backward relative to the orientation of ski 12 in order to secure top plate 18 within base plate 14. A first release lever 24 serves to disengage toe kick latch 20 while a second release lever 26 serves to disengage heel kick latch 22. Top plate 18 engages the base plate 14 via a first or toe support 28 and a second or heel support 30, respectively. Both toe kick latch 20 and heel kick latch 22 are spring loaded so that when a sufficient force is applied to top plate 18, such as when a skier falls, the toe kick latch 20 or heel kick latch 22 will travel a sufficient enough distance to release its respective toe support 28 or heel support 30. This releases the top plate and frees the skier from possible bodily injury or property damage.

Additionally, with the platform provided by the binding system 10, snowboarders and skiers can eliminate the need for risers or "gas pedals" normally used to reduce toe and heel drag. For example, in skiing, traditional bindings place the ski boot right on the surface of the ski, which can lead to drag as the skier cuts sharply for a turn. Risers have been used to elevate the ski boot above the top surface of the ski, thereby reducing or eliminating drag. These risers are no longer necessary when the binding apparatus 10 is utilized instead.

The tension for the springs that control the force on toe latch 20 and heel latch 22 is adjustable via an adjusting screw 32 and 34, respectively; Each screw 32 and 34 may be turned with either an Allen wrench or a screwdriver, such as a flat head or a Phillips, so that proper tension desired by the user can be quickly achieved. To protect the spring and latching mechanism, a cover plate 36 is firmly secured atop the base plate 14 and is supported by cover support tabs 37. Cover support tabs 37 are integrated within base plate 14.

Figure 2:
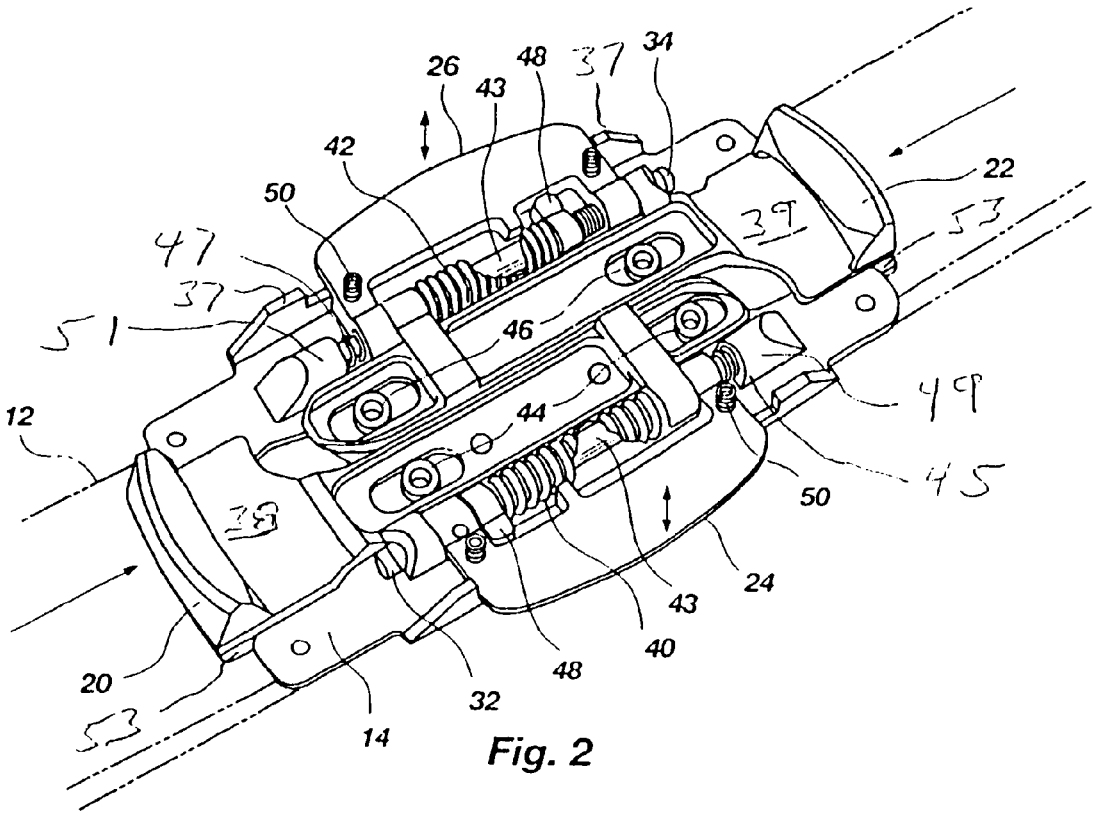
FIG. 2 illustrates a perspective view of the inside mechanism utilized in the universal binding system where the toe and heel plates are in an open or released position.
Figure 3:
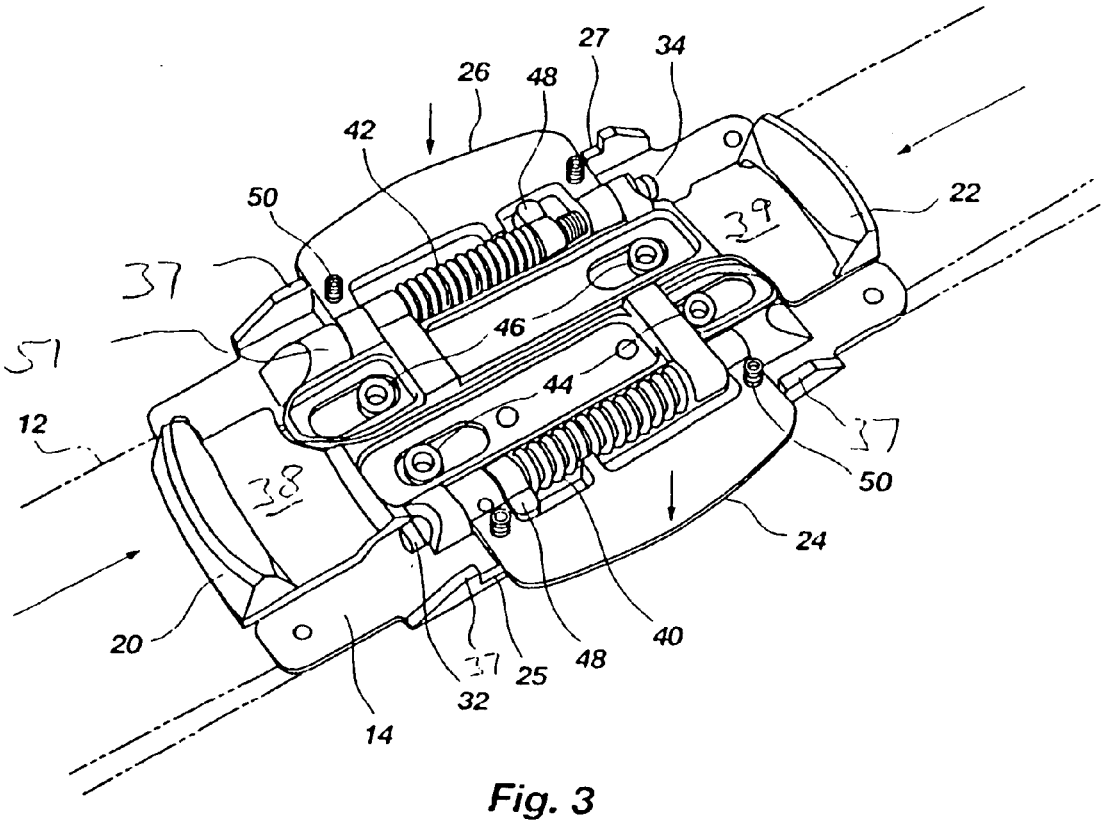
FIG. 3 illustrates the same perspective view as FIG. 2, but represents the toe and heel kick plates to be in a secured position.

FIGS. 2 and 3 illustrate first a release position (FIG. 2) and then a secure position (FIG. 3). It is noted that the kick latches 20 and 22 move in opposite directions along the same line of engagement in order to secure top plate 18.

Each kick latch 20 and 22, as previously stated, is held within a fixed position by release levers 24 and 26, respectively. First release lever 24 causes toe kick latch 20 to release and disengage the top plate 18 when lifted upwardly. Second release lever 26 operates in the same manner for releasing heel kick latch 22. Release levers 24 and 26 allow the rider conveniently to release him self while in deep powder or in any other situation. A lanyard or cord can be attached to either release lever 24 or 26 so that the rider can pull on the cord from a distance in order to release the rider from the board.

Figure 4:
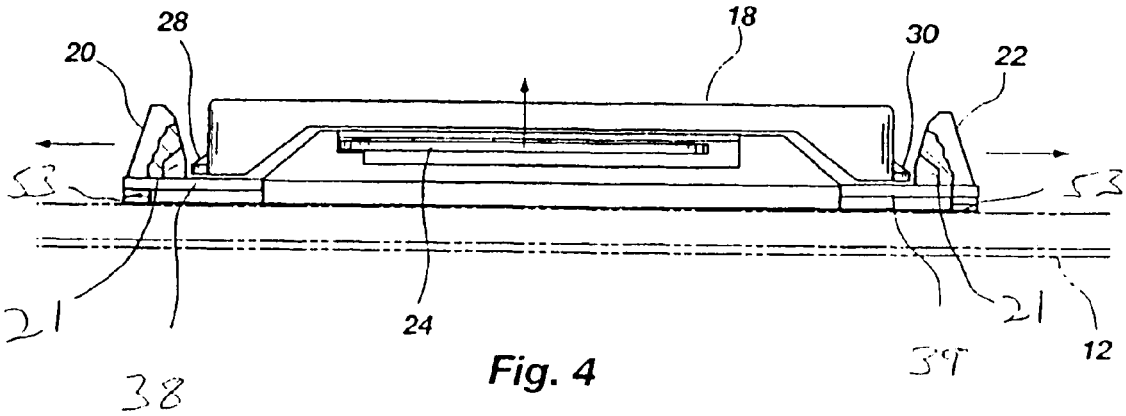
FIG. 4 is a side plan view of the universal binding apparatus according to claim 1 but illustrates the first release in a full release position.
Figure 5:
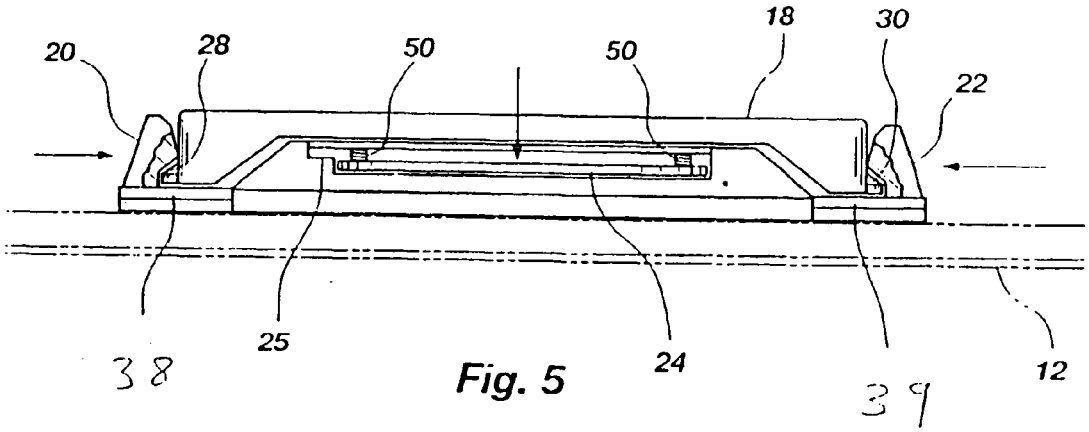
FIG. 5 illustrates the same side plan view of FIG. 4, but the first release is in a latched position.

Once one of the kick plates has been released either in a fall or by one of the release lever 24 or 26, the rider can then reengage the kick latch 20 or 22 by simply kicking them in the retaining position towards the main body of the bottom plate 14. This feature allows the rider to reengage the bindings without needing to bend over or sit down in the snow, which then allows the rider to step back into the binding apparatus without difficulty. Kick latches 20 and 22 slide back so that release levers 24 and 26 are held in place via release notches 25 and 27, respectively, as shown in FIGS. 4 and 5. FIG. 4 illustrates the position of toe kick latch 20 in the released position while FIG. 5 illustrates the kick latches 20 and 22 engaging the top plate 18.

Each kick latch 20 and 22 further includes a recess 21, which is utilized to retain or hold toe support 28 or heel support 30 in place when kick latches 20 and 22 are moved to their latch position.

Toe kick latch 20 is actually part of a kick plate 38 as shown in FIGS. 2 and 3. Kick plate 38 is held in place within base plate 14 via a pair of set screws 44, which allow kick plate 38 to slide between a first and second position. Likewise, heel kick latch 22 is part of a kick plate 39, which can slide freely, but is held in place via set screws 46. Set screws 46 are identical to set screws 44. Each kick plate 38 and 39 is designed to be identical in configuration, which simplifies production, assembly and replacement or repair work.

The base plate 14 further includes several sets of springs, which are used to provide tension and force for holding the latches 20 and 22 in position and enable them to release under desired conditions. A first set of springs includes springs 40 and 42. Springs 40 and 42 serve to bias the kick plates 20 and 22, respectively, opposite one another. The large set of springs 40 and 42 control the release tension as well. The next set of springs 45 and 47 are placed within spring retainers 49 and 51, respectively. Springs 45 and 47 serve to control the lateral pressure on the release levers 24 and 26. The last set of springs 50 ride in shallow cavities etched into the under surface of cover 36. Springs 50 support the base plate cover 36 and urge the release lever 24 and 26 in place, below notches 25 and 27, respectively, once the latches 20 and 22 are moved into their retention orientation.

Each main spring 40 and 42 is held in position by a binding release tension shaft 43, which allows the spring to be compressed for a given tension as well as secures the release lever 24 and 26 in combination with the kick latches 20 and 22, respectively. A cam 48 is also moveably secured on binding release tension shaft 43 and operates with the release plate to adjust the release tension of either kick plate 38 or kick plate 39 when they are engaged with the release levers 24 or 26. As the tension adjustment screw 32 or 34 is turned, the cam 48 is retained within notches formed in part of the release levers 24 and 26 such that the spring force is increased or decreased, depending on how the screws are turned. Binding release tension shaft 43 can have either right handed or left handed threads. Retention tabs 53 are formed under each of kick latch 20 and 22 and which engage plate 14 while engaging the top plate 18. Retention tabs 53 engage notches 72, shown in FIG. 11.

Cover plate 36 has a useful shape that allows it to rest against the top plate surfaces to eliminate problems with release consistency that are typically caused by floating or "relative," tension between the heel and toe releases. Cover plate 36 is prevented from traveling against top plate 18; otherwise, the top plate would float on the cover. Cover plate 36, therefore, serves as a cover retention and release surface.

The universal binding system 10 is designed to work well with very narrow skis and the release plates are modified to be utilized with a conventional ski. A rider can then use the same universal binding system on any other board that they may use which allows them to use the same boots with either the skis or the snowboard. The system is also able to work with most soft bindings and boots as a firm exoskeleton, shown in FIG. 10, can be adapted to include a top plate 18 for binding with bottom plate 14.

Figure 6:
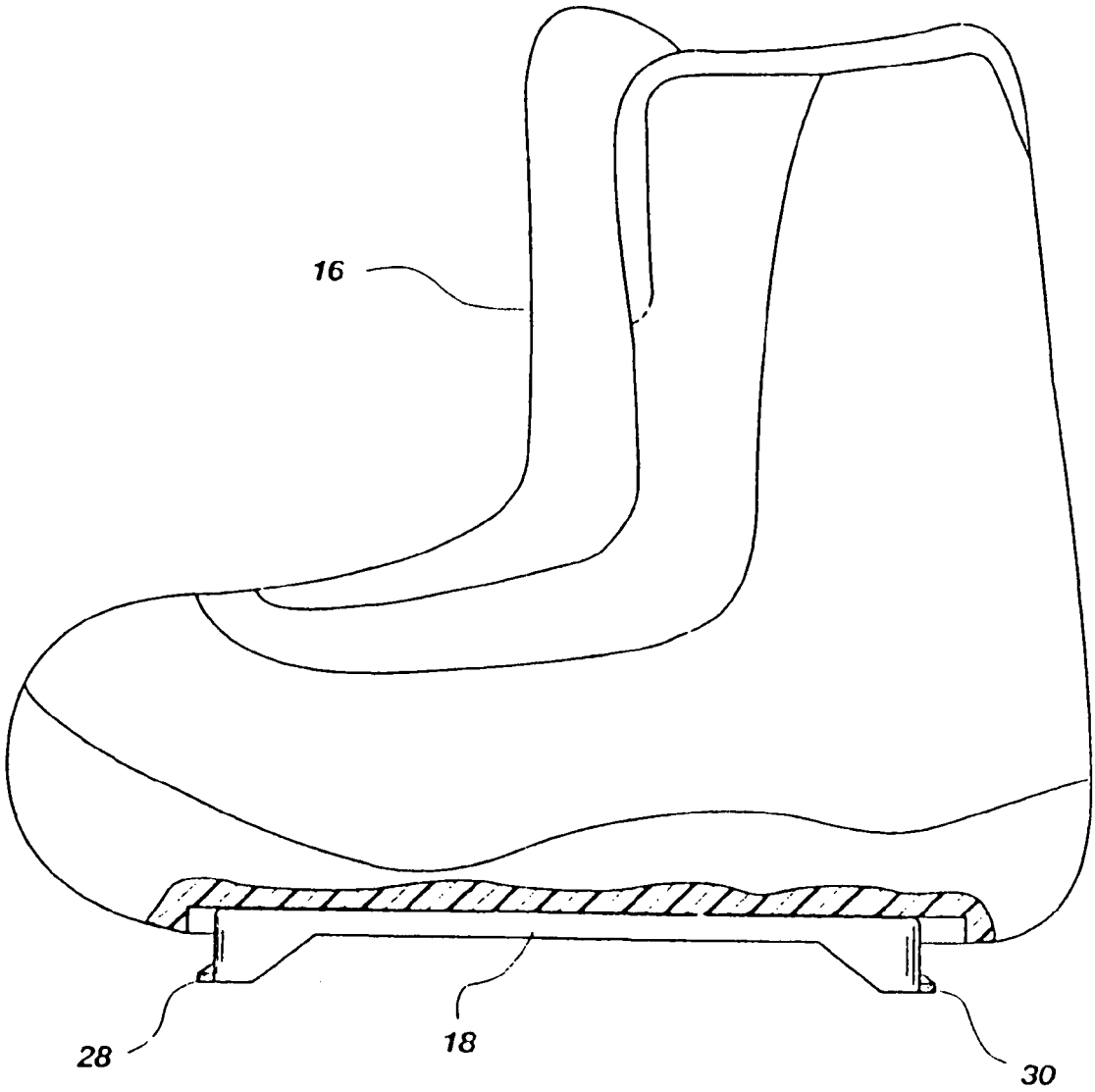
FIG. 6 illustrates a side view of the top plate of FIG. 1 as secured and integrated within a footwear, such as a ski boot.

The top plate 18 can be integrated with a footwear article such as a boot 16 shown in FIG. 6. Further, plate 18 may be secured to the bottom of boot 16 via a plurality of set screws or other attachment means such as glue or bonding. Further, retention supports 28 and 30 may be removable for replacement should they either wear out or stronger supports are necessary for more advanced skiing techniques.

Figure 7:
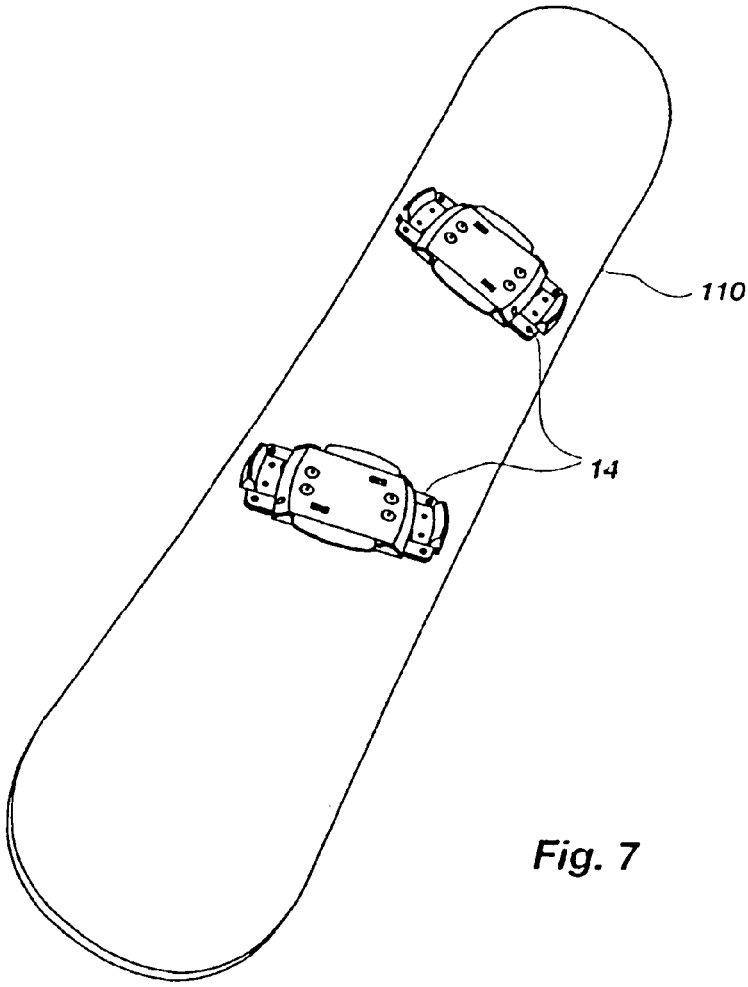
FIG. 7 illustrates the universal binding apparatus as implemented on a snow or wake board.
Figure 8:
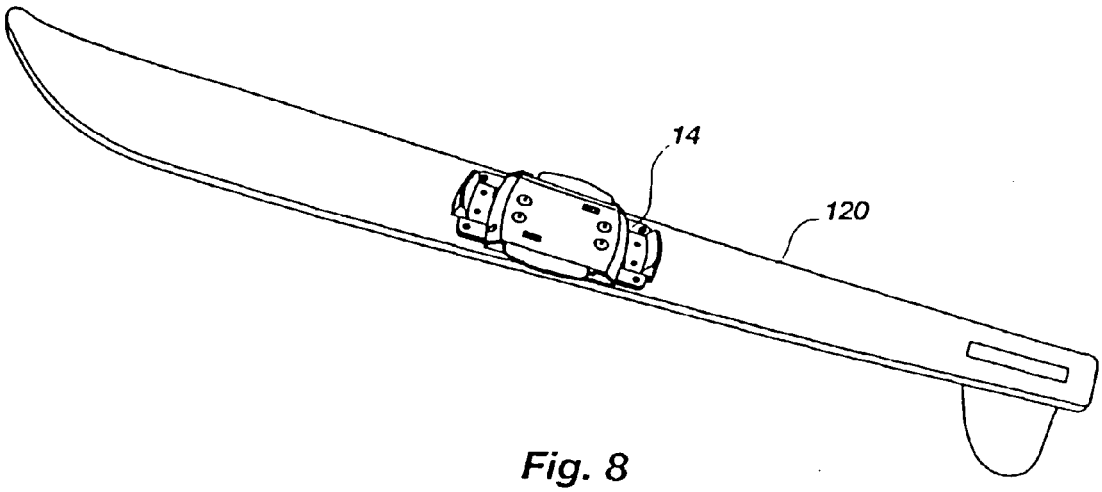
FIG. 8 illustrates the universal binding apparatus as incorporated in a water ski design.

FIG. 7 illustrates the use of and placement of base plates 14 on a snowboard 110. The orientation of each base plate 14 may be adjusted about a given circle, which is described more fully with reference to FIG. 11 below. The base plate 14 may also be attached to a water ski 120 as illustrated in FIG. 8. A wake board, which as a similar configuration as that as the snowboard 110, can also incorporate the binding apparatus 10 of the present invention.

Figure 9:
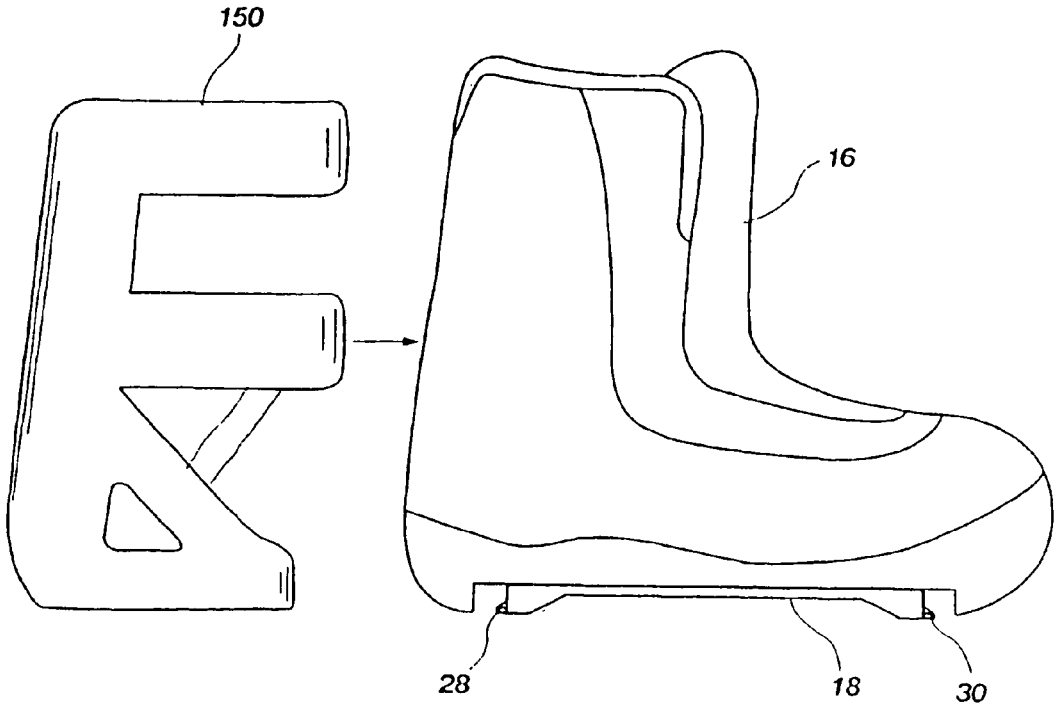
FIG. 9 illustrates a first embodiment of an exoskeleton support in accordance with the present invention.
Figure 10:
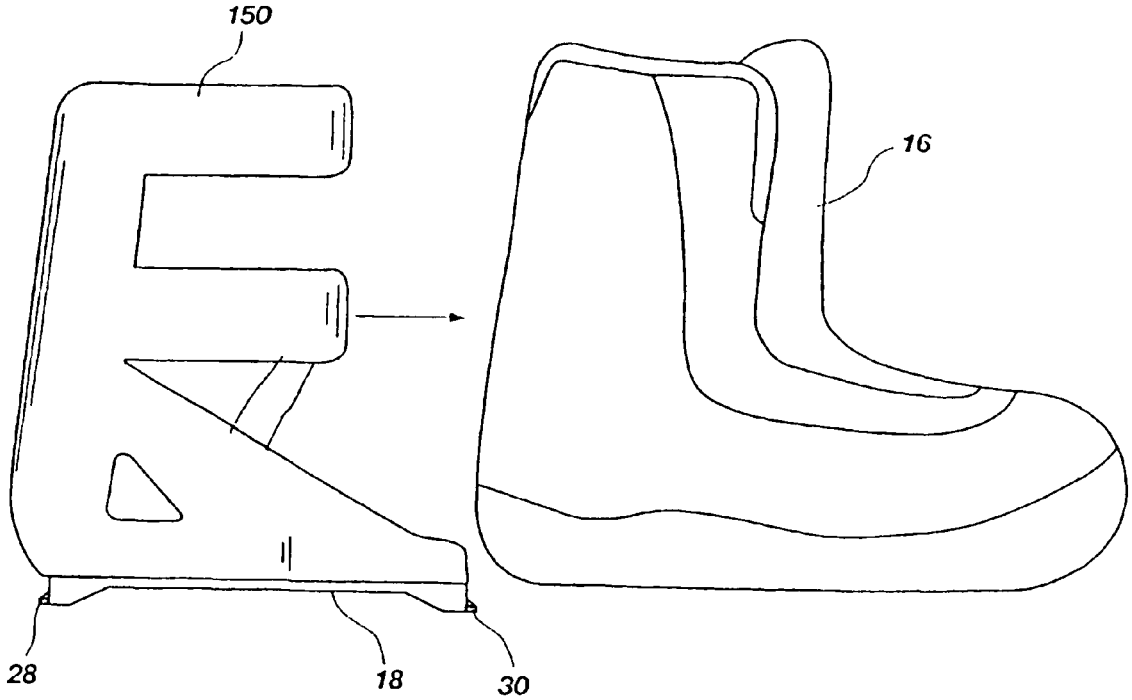
FIG. 10 illustrates an alternative embodiment of the exoskeleton support in accordance with the present invention.

FIG. 9 illustrates an embodiment of a detachable exoskeleton 150 that fits on the outside of boot 16. Boot 16 includes top plate 18 mounted to its sole. The exoskeleton provides added rigidity and support to the skier's boot, if it is a soft boot, so that substantial torque can be generated for the binding system to work. A strap, or other binding device such as latches or clips or laces, is utilized to secure the exoskeleton to the boot. FIG. 10 illustrates an alternative embodiment to that of FIG. 9 wherein the exoskeleton has the top plate 18 attached to its sole, instead of to the user's boot. In this embodiment the exoskeleton 150 has a rigid sole for mounting on plate 18. Alternatively, plate 18 can be integrated with exoskeleton 150 for a stronger support and stiffer boot.

Additional features can include a board break or a leash used to secure the ski or board to the skier should the board or ski becomes detached from the skier. A cable that connects to one of the wings and is within easy reach of the rider can be pulled for quick release of the release lever 28 or 30, or both, and top plate 18. The cable can extend either within the boot or exoskeleton or on the outside thereof.

Figure 11:
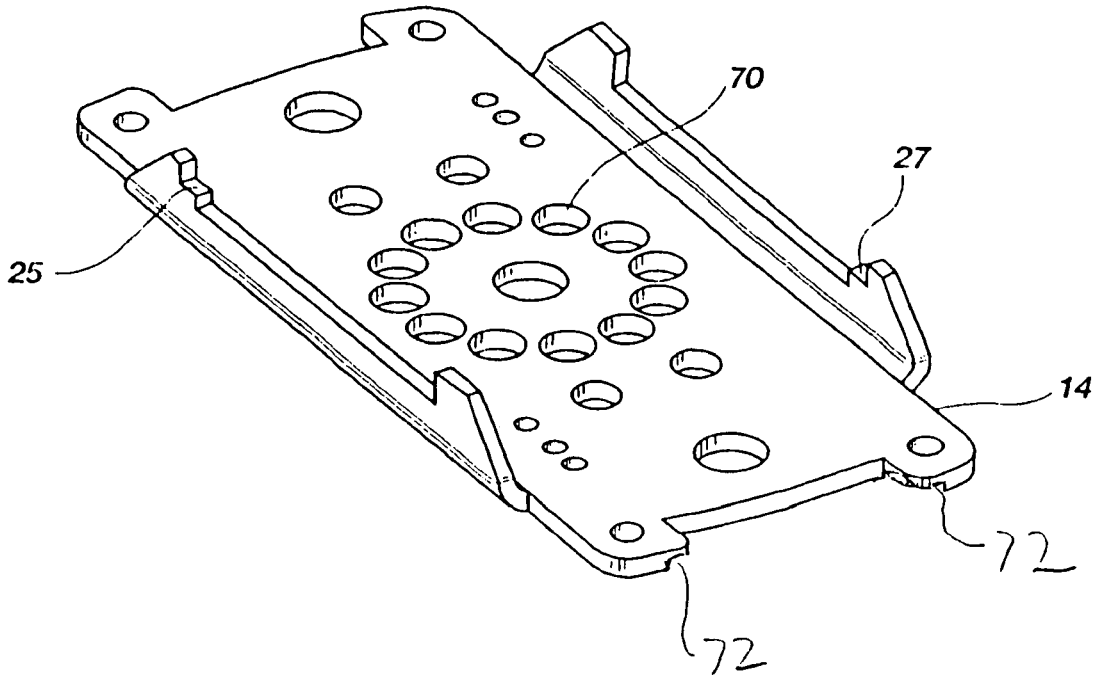
FIG. 11 illustrates a perspective view of the base plate according to the present invention.

FIG. 11 illustrates a top plan view of base plate 14 without any of the kick plate release assemblies, springs, retention rods, and the rest. A circle of apertures 70 serve as mounting locations. Most snowboards, skiboards, and skis have standardized placement holes and the circle of apertures 70 allows the base plate 14 to be mounted in any radius or orientation with respect to the standard holding apertures on the snowboard. It should be noted that the base plate 14 can also include apertures for securing the base plate to a skiboard or water ski board in standard apertures typically found on the skiboards themselves. Notches 72 are formed on the bottom inside edges of base plate 14 and serve to receive retention tabs 53 of FIGS. 1 and 2.

Figure 12:
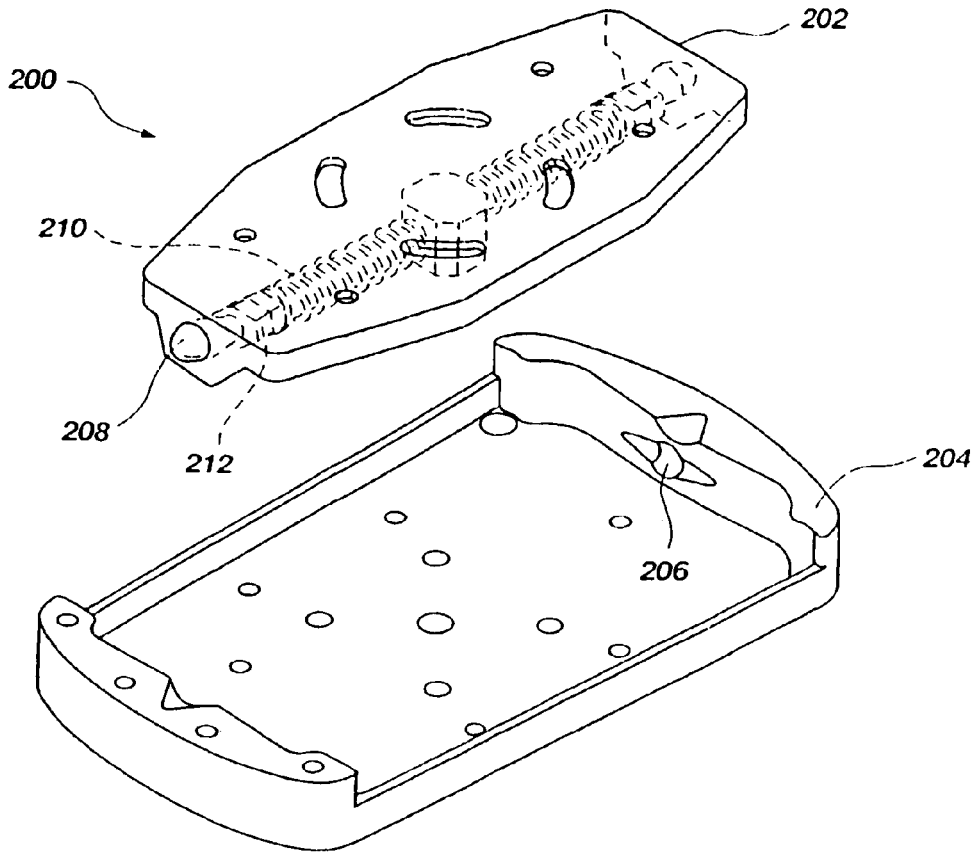
FIG. 12 illustrates an alternative embodiment of the binding system in accordance with the present invention.

FIG. 12 illustrates an alternative embodiment of the binding release system in accordance with the present invention. The binding system 200 includes a first or top plate 202 and a second or bottom plate 204. Bottom plate 204 mounts to the sports equipment much in the same manner as does bottom plate 12. Bottom plate 204 includes bullet catch recesses 206, which engage and retain top plate 202 in place upon insertion. Top plate 202 includes a pair of spring loaded bullet catches 208, which fit in recesses 206. A spring 210 provides outward biasing so that a selected force is required to remove top plate 202 from bottom plate 204. A tension adjustment nut 212 fits on one end of the bullet catch 208 and can be turned so as to increase or decrease the tension placed on spring 210.

Figure 13:
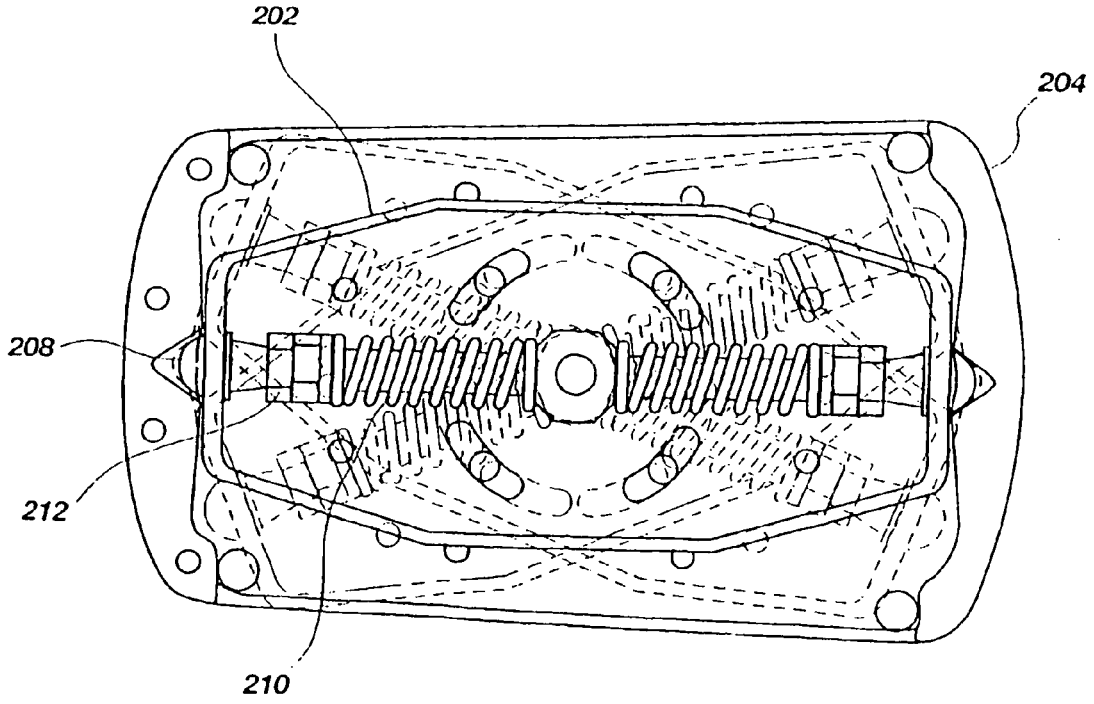
FIG. 13 illustrates how the top plate can release from the bottom plate of the binding system depicted in FIG. 12.

FIG. 13 illustrates how top plate 202 can twist in a plane horizontal to bottom plate 204 for release. Top plate 202 can also pull upwardly, providing a full range of release motion. Like the binding assembly 10 described earlier, binding system 200 is also universal in that it can be used on skis, snowboards, water skis, and other related sports equipment.

Figure 14:
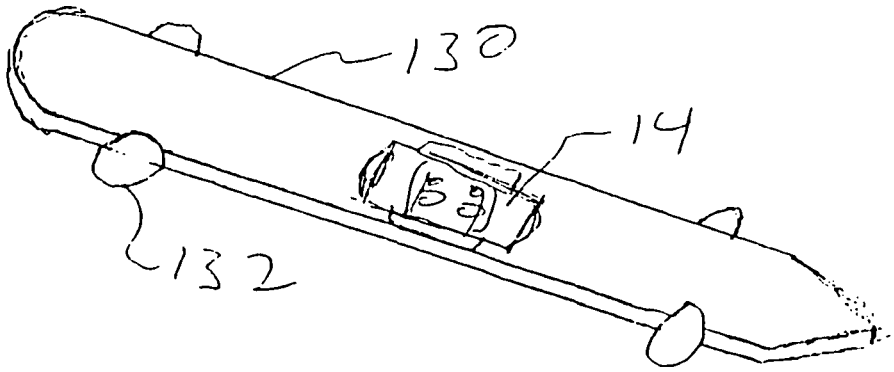
FIG. 14 illustrates the universal binding apparatus as incorporated in a roller board apparatus.

FIG. 14 illustrates a roller board type apparatus 130 that has wheels or rollers 132 and a base plate 14, like that of FIG. 1. Roller board 130 can be a turf board, mountain board, skateboard, or roller skis, or any other roller board type apparatus.

In one embodiment, the universal binding system incorporates an integrated boot, binding, and ski system, such as a snow ski or snowboard system. The skis can also includes Z Ski line (trademark) of skis and boards and well as Z sculptured or standard skis, Z twintip skis, Z water skis, Z wake boards, which are all offered by Miller Sports International, of Utah, and other boards modified with an insert pattern that matches the base plate to allow easy switching between sports and boards using the same binding or boots.

Not only can the binding system be utilized on snow skis, water skis, or snowboards, but it may also be utilized on boards that either have wheels for rolling, riding, or other types of sliding boards. For example, year round ski training often utilize roller skis, which can incorporate the bindings. Skateboards can also incorporate the bindings in certain applications. Other systems may include kite boards or sailboards.

It is to be understood that the above-described arrangements are only illustrative of the application for the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

The invention claimed is:

1. A universal binding apparatus for detachably securing a footwear-type article to multiple different articles, the apparatus comprising:

a first plate that can attach to a first article and that comprises:

a toe retaining latch, disposed at a front portion of the first plate;

a heel retaining latch, disposed at a rear portion of the first plate; and a first release, disposed between the toe retaining latch and the heel retaining latch, to disengage either the toe retaining latch or the heel retaining latch;

a second plate that can attach to a second article not secured to first plate and that comprises:

a toe support, disposed at a front portion of the second plate; and a heel support, disposed at a rear portion of the second plate, wherein the second plate is detachably secured to the first plate with the toe support engaged within the toe retaining latch and the heel support engaged within the heel retaining latch and wherein the first release operates to movably disengage either the toe retaining latch or the heel retaining latch or both from the second plate, the second plate also being configured to interchangeably and detachably secure to a third plate of a third article of a different type than the second article, the third plate being configured similar to the first plate to secure the second plate.

2. A universal binding apparatus for detachably securing a footwear-type article to a second article, the apparatus comprising:

a first plate that can attach to either article and that comprises:

a toe latch, disposed at a front portion of the first plate;

a heel latch, disposed at a rear portion of the first plate; and a first release, disposed between the toe latch and the heel latch, to disengage either the toe latch or the heel latch;

a second plate that can attach to the other article not secured to the first plate and that comprises:

a toe support, disposed at a front portion of the second plate; and a heel support, disposed at a rear portion of the second plate, wherein the second plate is detachably secured to the first plate with the toe support engaged with the toe latch and the heel support engaged with the heel latch, and wherein the first release operates to disengage either the toe latch or the heel latch or both from the second plate, wherein the first plate further comprises a second release, disposed between the toe latch and the heel latch on a side opposite the first release, and the first release is coupled to the toe latch and the second release is coupled to the heel latch such that the first release controls the toe latch and the second release controls the heel latch, the second plate also being configured to interchangeably and detachably secure to a third plate of a third article of a different type than the second article, the third plate being configured similar to the first plate to secure the second plate.

3. The universal binding apparatus according to claim 1 or 2 wherein the article is a snow ski and the footwear-type article comprises a snow ski boot.

4. The universal binding apparatus according to claim 1 or 2 wherein the article comprises a snowboard and the footwear comprises a snowboard boot.

5. The universal binding apparatus according to claim 1 wherein the force used by the toe retaining latch to engage and release the toe support is adjustable.

6. The universal binding apparatus according to claim 1 wherein the force used by the heel retaining latch to engage and release the heel support is adjustable.

7. The universal binding apparatus according to claim 1 wherein the toe retaining latch is spring biased in a first direction and operable between a first position and a second position, as controlled by the first release.

8. The universal binding apparatus according to claim 2 wherein the heel latch is spring biased in a first direction and operable between a first position and a second position, as controlled by the second release.

9. The universal binding apparatus according to claim 1 or 2 further comprising a boot support that removably attaches to the footwear-type article.

10. A universal binding apparatus for detachably securing a footwear to multiple different articles, the apparatus comprising:

a base plate that attaches to a first article and that comprises:

a first retaining latch, disposed at a front or rear portion of the base plate;

a second retaining latch, disposed at a front or rear portion of the base plate opposite the first latch; and a first release, disposed between the first and second retaining latches, to disengage the first retaining latch;

a foot plate that removably attaches to the footwear and that comprises:

a toe support, disposed at a front portion of the foot plate; and a heel support, disposed at a rear portion of the foot plate, wherein the foot plate is detachably secured to the base plate with the toe support engaged within either the first or second retaining latch and the heel support engaged within either the second or first retaining latch opposite the toe support and wherein the first release operates to movably disengage the first retaining latch from the foot plate, the foot plate also being configured to interchangeably and detachably secure to a base plate of a second article of a different type than the first article, the base plate of the second article being configured similar to the base plate of the first article to secure the foot plate.

11. A universal binding apparatus for detachably securing a footwear to multiple different articles, the apparatus comprising:

a base plate that attaches to a first article and that comprises:

a first latch, disposed at a front or rear portion of the base plate;

a second latch, disposed at a front or rear portion of the base plate opposite the first latch; and a first release, disposed between the first and second latches, to disengage the first latch;

a foot plate that removably attaches to the footwear and that comprises:

a toe support, disposed at a front portion of the foot plate; and a heel support, disposed at a rear portion of the foot plate, wherein the foot plate is detachably secured to the base plate with the toe support engaged with either the first or second latch and the heel support engaged with either the second or first latch opposite the toe support and wherein the first release operates to disengage the first latch from the foot plate, wherein the base plate further comprises a second release, disposed between the front latch and the rear latch on a side opposite the first release, wherein the first release is coupled to the first latch and the second release is coupled to the first latch such that the first release controls the first latch and the second release controls the second latch, the foot plate also being configured to interchangeably and detachably secure to a base plate of a second article of a different type than the first article, the base plate of the second article being configured similar to the base plate of the first article to secure the foot plate.

12. The universal binding apparatus according to claim 10 or 11 wherein the first article is a snow ski and the footwear comprises a snow ski boot.

13. The universal binding apparatus according to claim 10 or 11 wherein the article comprises a snowboard and the footwear comprises a snowboard boot.

14. The universal binding apparatus according to claim 10 wherein the force used by the first retaining latch to engage and release the toe support is adjustable.

15. The universal binding apparatus according to claim 10 wherein the force used by the second retaining latch to engage and release the heel support is adjustable.

16. The universal binding apparatus according to claim 10 wherein the first retaining latch is spring biased in a first direction and operable between a first position and a second position, as controlled by the first release.

17. The universal binding apparatus according to claim 11 wherein the second retaining latch is spring biased in a first direction and operable between a first position and a second position, as controlled by the second release.

18. The universal binding apparatus according to claim 13 wherein the footwear further comprises a boot support that removably attaches to the snowboard boot and to the foot plate.

19. A universal binding apparatus for detachably securing a footwear to multiple different articles, the apparatus comprising:

a base plate that can attach to the article and that comprises:

a toe retaining latch, disposed at a front portion of the base plate;

a heel retaining latch, disposed at a rear portion of the base plate; and a first release, disposed between the toe retaining latch and the heel retaining latch, to disengage either the toe retaining latch or the heel retaining latch;

a foot plate that can attach to the footwear and that comprises:

a toe support, disposed at a front portion of the foot plate; and a heel support, disposed at a rear portion of the foot plate, wherein the foot plate is detachably secured to the base plate with the toe support engaged within the toe retaining latch and the heel support engaged within the heel retaining latch, and wherein the first release operates to disengage either the toe retaining latch or the heel retaining latch or both from the foot plate, the foot plate also being configured to interchangeably and detachably secure to a base plate of a second article of a different type than the first article, the base plate of the second article being configured similar to the base plate of the first article to secure the foot plate.

20. A universal binding apparatus for detachably securing a footwear to an article, the apparatus comprising:

a base plate that can attach to the article and that comprises:

a toe latch, disposed at a front portion of the base plate;

a heel latch, disposed at a rear portion of the base plate; and a first release, disposed between the toe latch and the heel latch, to disengage either the toe latch or the heel latch;

a foot plate that can attach to the footwear and that comprises:

a toe support, disposed at a front portion of the foot plate; and a heel support, disposed at a rear portion of the foot plate, wherein the foot plate is detachably secured to the base plate with the toe support engaged with the toe latch and the heel support engaged with the heel latch and wherein the first release operates to disengage either the toe latch or the heel latch or both from the foot plate, the base plate further comprises a second release, disposed between the toe latch and the heel latch on a side opposite the first release, wherein the first release is coupled to the toe latch and the second release is coupled to the heel latch such that the first release controls the toe latch and the second release controls the heel latch, the foot plate also being configured to interchangeably and detachably secure to a base plate of a second article of a different type than the first article, the base plate of the second article being configured similar to the base plate of the first article to secure the foot plate.

21. The universal binding apparatus according to claim 19 or 20 wherein the article is a snow ski and the footwear comprises a snow ski boot.

22. The universal binding apparatus according to claim 19 or 20 wherein the article comprises a snowboard and the footwear comprises a snowboard boot.

23. The universal binding apparatus according to claim 19 wherein the force used by the toe retaining latch to engage and release the toe support is adjustable.

24. The universal binding apparatus according to claim 19 wherein the force used by the heel retaining latch to engage and release the heel support is adjustable.

25. The universal binding apparatus according to claim 19 wherein the toe retaining latch is spring biased in a first direction and operable between a first position and a second position, as controlled by the first release.

26. The universal binding apparatus according to claim 20 wherein the heel latch is spring biased in a first direction and operable between a first position and a second position, as controlled by the second release.

27. The universal binding apparatus according to claim 22 wherein the footwear further comprises a boot support that removably attaches to the snowboard boot and to the foot plate.

28. A universal binding apparatus for detachably securing a footwear article to a second article, comprising:

a first plate that is attachable to either article and that has a first biased retaining detent that can move between a first position and a second position and a second biased retaining detent biased in a direction opposite that of the first biased retaining detent;

a second plate that can attach to the other article not secured to first plate and that has a first detent receiving recess wherein the first biased retaining detent engages the first recess when the first plate is mated to the second plate and wherein the first biased retaining detent disengages the first recess when a release force is applied to either the footwear article or the second article, the second plate further comprising a second recess placed a fixed distance opposite the first recess and wherein the second biased retaining detent engages the second recess when the first plate is mated with the second plate and disengages the second recess upon application of the release force, the second plate also being configured to interchangeably and detachably secure to a third plate of a third article of a different type than the second article, the third plate being configured similar to the first plate to secure the second plate.

29. The universal binding apparatus according to claim 28 wherein at least one of the first and second biased retaining detents comprises a bullet detent biased by a spring.

30. The universal binding apparatus according to claim 28 wherein the bias on at least one of the first and second biased retaining detents is adjustable.

* * * * *